US005254967A

United States Patent [19]

Biasutti et al.

[11] Patent Number: 5,254,967

[45] Date of Patent: Oct. 19, 1993

[54] DUAL ELEMENT FUSE

[75] Inventors: Tony Biasutti, Mississauga; Peter Morgan, Toronto; Mary A. Ruggiero, Toronto; Brian A. Young, Toronto, all of Canada

[73] Assignee: Nor-Am Electrical Limited, Toronto, Canada

[21] Appl. No.: 994,951

[22] Filed: Dec. 22, 1992

[30] Foreign Application Priority Data

Oct. 2, 1992 [CA] Canada ..... 2079722

[51] Int. Cl.[5] ..... H01H 85/04

[52] U.S. Cl. ..... 337/165; 337/164

[58] Field of Search ..... 337/164, 163, 165, 166, 337/161, 162

[56] References Cited

U.S. PATENT DOCUMENTS

| | | |
|---|---|---|
| 1,001,698 | 12/1912 | Howard . |
| 1,072,156 | 2/1913 | Blewitt . |
| 1,084,706 | 1/1914 | Murray . |
| 1,155,154 | 10/1915 | Knapp, Jr. . |
| 1,173,087 | 8/1916 | Ross . |
| 1,189,117 | 6/1917 | O'Brien . |
| 1,196,364 | 11/1917 | Barry et al. . |
| 1,196,942 | 11/1917 | Jarosy et al. . |
| 1,200,575 | 2/1918 | Cameron . |
| 1,202,056 | 3/1918 | Gaia . |
| 1,228,102 | 10/1918 | Kowalik et al. . |
| 1,228,855 | 11/1918 | Gaia . |
| 1,235,172 | 4/1919 | Kowalik et al. . |
| 1,250,872 | 3/1920 | Krueger . |
| 1,251,500 | 3/1920 | Cameron . |
| 1,290,374 | 9/1920 | Thwaites . |
| 1,299,132 | 4/1921 | Conant . |
| 1,422,419 | 7/1922 | Conant . |
| 1,422,420 | 7/1922 | Conant . |
| 1,601,726 | 10/1926 | Eustice . |
| 1,857,097 | 5/1932 | Glowacki . |
| 1,857,098 | 5/1932 | Glowacki . |
| 1,919,273 | 7/1933 | Conant . |
| 1,991,876 | 2/1935 | Wood . |
| 2,014,844 | 9/1935 | Spalding et al. . |
| 2,014,845 | 9/1935 | Spalding et al. . |
| 2,015,285 | 9/1935 | Ehlmann et al. . |
| 2,017,490 | 10/1935 | Glowacki . |
| 2,029,081 | 1/1936 | Krueger et al. . |
| 2,044,636 | 6/1936 | Douglas . |
| 2,055,115 | 9/1936 | Wood . |
| 2,079,097 | 4/1937 | Wood . |

(List continued on next page.)

FOREIGN PATENT DOCUMENTS

| | | |
|---|---|---|
| 1052426 | 4/1979 | Canada . |
| 1096913 | 3/1981 | Canada . |
| 1122247 | 4/1982 | Canada . |
| 1135306 | 11/1982 | Canada . |
| 1143415 | 3/1983 | Canada . |
| 1157499 | 11/1983 | Canada . |
| 1174716 | 9/1984 | Canada . |
| 1266290 | 2/1990 | Canada . |
| 59310 | 4/1891 | Fed. Rep. of Germany . |

*Primary Examiner*—Harold Broome

*Attorney, Agent, or Firm*—Riches, McKenzie & Herbert

[57] ABSTRACT

An electrical interruption device is disclosed in which a space efficient spiral spring activates current interruption. The spring is characterized by coils which wind continuously about and approach a central axis, with successive coils of the spring having reduced radius to pass axially through the center of an outwardly adjacent coil. The spring may further be made to assume a flat condition with the spring coils lying flat, nesting interposed between adjacent coils. Advantageously, the spiral spring is conical in shape and is tensioned in a reverse loaded configuration wherein the coils of one end of the spring are pulled axially inward, through and past the coils of other end. Preferably the reverse loaded conical spring forms part of a thermally sensitive device which includes a housing having disposed therein a plunger which is in a biased relationship with the spring. The plunger extends beyond the housing to provide electrical communication with the remainder of the electric circuit, and is held in place against the force of the spring by a meltable solder. On a predetermined condition causing the solder to melt, the plunger is released, whereby it is moved by the force of the spring into the housing and out of electric communication with the remainder of the electric circuit.

26 Claims, 3 Drawing Sheets

U.S. PATENT DOCUMENTS

| | | |
|---|---|---|
| 2,300,620 | 11/1942 | Duerkob . |
| 2,321,711 | 6/1943 | Taylor . |
| 2,400,408 | 5/1946 | Haefelinger . |
| 2,543,245 | 2/1951 | Laing . |
| 2,577,531 | 12/1951 | Laing . |
| 2,613,297 | 10/1952 | Laing . |
| 2,640,128 | 5/1953 | Fahnoe et al. . |
| 2,657,294 | 10/1953 | Laing . |
| 2,658,974 | 11/1953 | Kozacka . |
| 2,694,124 | 11/1954 | Laing et al. . |
| 2,703,352 | 3/1955 | Kozacka . |
| 2,720,567 | 10/1955 | Detch . |
| 2,734,111 | 2/1956 | Kozacka . |
| 2,747,257 | 5/1956 | Ashcroft et al. . |
| 2,809,254 | 10/1957 | Edsall . |
| 2,816,988 | 12/1957 | Sugden . |
| 2,826,660 | 3/1958 | Kozacka . |
| 2,833,891 | 4/1958 | Jacobs, Jr. . |
| 2,834,852 | 4/1958 | Swain et al. . |
| 2,913,555 | 1/1959 | McAlister . |
| 2,982,835 | 4/1961 | Kozacka . |
| 3,110,855 | 11/1963 | Chumakov . |
| 3,116,389 | 12/1963 | Withers . |
| 3,144,534 | 8/1964 | Baumbach . |
| 3,206,579 | 9/1965 | Berthel et al. . |
| 3,240,905 | 3/1966 | Kozacka . |
| 3,287,526 | 11/1966 | Brandt . |
| 3,291,941 | 12/1966 | Salzer . |
| 3,319,029 | 5/1967 | Jacobs, Jr. . |
| 3,374,328 | 3/1968 | Cameron . |
| 3,417,357 | 12/1968 | Withers . |
| 3,418,614 | 12/1968 | Krueger . |
| 3,453,580 | 7/1969 | Withers . |
| 3,479,630 | 11/1969 | Kozacka . |
| 3,483,501 | 12/1969 | Kozacka . |
| 3,491,322 | 1/1970 | Kozacka . |
| 3,611,239 | 10/1971 | Kozacka . |
| 3,648,210 | 3/1972 | Kozacka . |
| 3,649,942 | 3/1972 | Plasko . |
| 3,681,731 | 8/1972 | Kozacka . |
| 3,689,995 | 9/1972 | Lerstrup . |
| 3,697,916 | 10/1972 | Belcher et al. . |
| 3,701,069 | 10/1972 | Belcher . |
| 3,721,935 | 3/1973 | Kozacka . |
| 3,863,188 | 1/1975 | Knapp, Jr. . |
| 3,876,966 | 4/1975 | Fister . |
| 3,935,553 | 1/1976 | Kozacka et al. . |
| 3,938,067 | 2/1976 | Fister . |
| 4,020,441 | 4/1977 | Jacobs, Jr. . |
| 4,032,877 | 6/1977 | McAlister . |
| 4,041,435 | 8/1977 | Gaia . |
| 4,048,610 | 9/1977 | Jacobs, Jr. . |
| 4,053,860 | 10/1977 | Kozacka et al. . |
| 4,053,862 | 10/1977 | Csizy et al. . |
| 4,055,827 | 10/1977 | Knapp, Jr. . |
| 4,058,786 | 11/1977 | Gaia et al. . |
| 4,101,860 | 7/1978 | Fister . |
| 4,117,441 | 9/1978 | Wycklendt . |
| 4,118,684 | 10/1978 | Mollenhoff . |
| 4,146,863 | 3/1979 | Mollenhoff . |
| 4,184,187 | 1/1980 | Gaia et al. . |
| 4,204,184 | 5/1980 | Csizy et al. . |
| 4,210,892 | 7/1980 | Salzer . |
| 4,216,457 | 8/1980 | Panaro . |
| 4,219,795 | 9/1980 | Panaro et al. . |
| 4,227,167 | 10/1980 | Kozacka et al. . |
| 4,227,168 | 10/1980 | Knapp, Jr. . |
| 4,308,515 | 12/1981 | Rooney et al. . |
| 4,315,235 | 2/1982 | Jacobs, Jr. . |
| 4,321,574 | 3/1982 | Pertici . |
| 4,331,947 | 5/1982 | Noerholm . |
| 4,344,058 | 8/1982 | Knapp, Jr. et al. . |
| 4,349,802 | 9/1982 | Gaia . |
| 4,357,588 | 11/1982 | Leach et al. . |
| 4,359,708 | 11/1982 | Jarosz et al. . |
| 4,367,451 | 1/1983 | Panaro . |
| 4,414,526 | 11/1983 | Panaro . |
| 4,417,224 | 11/1983 | Ross . |
| 4,481,495 | 11/1984 | Jarosz et al. . |
| 4,488,137 | 12/1984 | Rooney et al. . |
| 4,503,415 | 3/1985 | Rooney et al. . |
| 4,511,874 | 4/1985 | Rasmussen et al. . |
| 4,533,895 | 8/1985 | Kowalik et al. . |
| 4,562,420 | 12/1985 | Kowalik et al. . |
| 4,593,262 | 6/1986 | Krueger . |
| 4,611,192 | 9/1986 | Arora . |
| 4,625,195 | 11/1986 | Robbins . |
| 4,636,765 | 1/1987 | Krueger . |
| 4,651,119 | 3/1987 | Belcher et al. . |
| 4,654,620 | 3/1987 | Rooney et al. . |
| 4,782,317 | 11/1988 | Thwaites . |
| 4,935,716 | 6/1990 | Ehlmann . |
| 4,972,170 | 11/1990 | Ehlmann . |
| 4,973,932 | 11/1990 | Krueger et al. . |
| 4,992,770 | 2/1991 | Spalding et al. . |
| 4,994,779 | 2/1991 | Douglass . |
| 5,043,689 | 8/1991 | Di Troia et al. . |
| 5,055,817 | 10/1991 | O'Shields et al. . |
| 5,075,664 | 12/1991 | Spalding et al. . |
| 5,077,534 | 12/1991 | Douglass . |
| 5,091,712 | 2/1992 | Suuronen . |
| 5,148,140 | 9/1992 | Goldstein . |

DUAL ELEMENT FUSE

SCOPE OF THE INVENTION

This invention relates to electrical interruption devices and more particularly to an electrical fuse which is designed to de-energize an electric circuit after either a predetermined interval of a sustained overload current, or almost immediately under a given high over current, as for example occurs during short circuit conditions.

BACKGROUND OF THE INVENTION

Fuses for protecting electrical circuits are well known. Typically known fuses include an insulating tube or casing which may be made of non-conductive material, such as glass, ceramic or the like. Each of the opposite ends of the tube are closed by a pair of electrically conductive end terminals. An electrically conductive element is provided within the tube, connecting each of the terminals to allow the current to pass therebetween.

In a conventional short circuit fuse, the conductive element is provided with one or more constrictions which overheat and melt almost immediately during a time of a short circuit, producing a high peak reverse voltage Conventional fuses are disadvantageous in that the gap formed by the melting of the metal at the constriction during overloads may not be sufficiently large to eliminate the arcing of current thereacross.

In prior art dual element fuses, such as time delay or thermally sensitive fuses, an overload protection device is provided within the tube serially connected with the electric conductive element. The simplest type of overload protection device comprises a metal spring held in tension within the fuse with one end secured to a first end terminal, and the other opposite end connected by a heat meltable solder to an end of the electric conductive element. Under prolonged overload conditions, heat generated by the current flow, heats the solder to a temperature where it melts allowing the spring to pull away from the conductive element by its collapse. The collapse of the spring away from the electric conductive element produces a sufficient gap in the current path to break the electric circuit.

A second type of known overload protection device is formed as a preassembly of various parts, which is inserted in series with the conductive element. Known preassemblies typically include a cylindrical housing having disposed therein a plunger in a biased relationship with a compressed or extended helical spring. The plunger extends through and beyond one end of the housing to engage the conductive element. The spring provides a force against the plunger member in a direction away from the conductive element, toward reentry into the housing. A meltable solder joint is used to electrically connect the end of the plunger to the electric conductive element, thereby preventing the return of the plunger into the housing under the force of the spring.

Upon prolonged overload conditions within the protective circuit, heat generated by a sustained overload current flow through the preassembly and electric conductive element causes the solder joint to melt. Once the solder melts, the plunger member is drawn away from the electric conductive element under the force of the untensioning spring.

One disadvantage of most known overload protection devices is that when positioned within a fuse with filler material, the filler material must be kept from interfering with the operation of the protection device. Typically, this is accomplished by providing dividers to separate the overload protection devices as by forming a separate chamber.

Another disadvantage with fuses incorporating most known overload protection devices is that they are comparatively large, and are therefore unsuitable for use in smaller electrical circuits and the like.

In many fuse applications, the fuse must be of a particular exterior dimension. The fuses contain a number of components to be received within the fuse, frequently in axial alignment. A disadvantage of many fuses is that their individual components are too large to permit advantageous spacing of the components or the inclusion of additional components. In particular, comparatively large sizing of known fuses is required to ensure that on overload activation of the fuse there is provided a sufficient gap in the current path to eliminate arcing of current between the overload protective device and the conductive element. The fuse must be manufactured at least as long as the length of the gap required to break the flow of electricity taken together with the length of the helical spring when compressed.

A further factor attributing to the large size of know time delay fuses is that comparatively large springs are used to ensure there is sufficient force to rapidly and fully move the plunger away from the conductive element on melting of the solder joint.

SUMMARY OF THE INVENTION

Accordingly, it is an object of the invention to at least partially overcome the disadvantages of known prior art fuses by providing a fuse for either short circuit or overload protection which incorporates an electrical interruption device in which a space efficient spiral spring activates current interruption.

It is a further object of the invention to provide an overload protection device which incorporates in a preassembly, a relatively small spring which exerts a similar or greater force against a plunger as a conventional compressed or extended helical spring having a greater length.

It is another object of the invention to provide a fuse which incorporates an overload protection device and which does not require a separate chamber to keep filler material from interfering with the operation of the protection device.

The electrical interruption device of the present invention comprises a spiral spring having coils which wind continuously about and constantly approaching a central axis. The successive coils of the spring have sufficiently reduced radius to pass axially through the center of immediately outward adjacent coils. The spring comprises a large diameter first end coil which spirals inwardly to a relatively small diameter second other end coil. The curvature of spiral of the coils being such that the spring may assume a flat condition with the coils lying coplanar, nesting interposed between adjacent coils. Preferably, when unbiased the coils of spiral spring have an inherent tendency to assume either a flattened position where the first end coil is axially aligned with the second end coil or a generally conical position where the first end coil is axially spaced from the second end coil.

Preferably, the spiral coil spring for use with the present invention is a conical spring which is reverse loaded. By reverse loaded it is meant that one end portion of the spring is moved inwardly and pulled through and past the second other end portion.

In a preferred embodiment, the present invention provides circuit protection device for interrupting an electric current. The protection device comprises, a spiral spring held in tension extended in a first direction by a meltable junction, wherein under a predetermined current/time condition, the meltable junction melts to allow the collapse of the spring and break the path of the electric current.

Preferably the circuit protection device is formed as a preassembled grouping of components, and is used for interrupting a sustained moderate overload current.

In another embodiment, the present invention provides in a fuse having an insulating tube sealed by terminals, a conductive spiral spring provided in electrical communication in between the terminals, wherein the current path is along the conductive spring. The spring is secured between each of the terminals in a loaded position by a coupling member, such as a solder joint or a fusible constriction. On a predetermined over current, the coupling member is caused to release the spring to allow its collapse, breaking the current path.

In a further embodiment, the electric fuse of the present invention comprises a tube of non-conducting material. Preferably, separate means for interrupting major fault currents and for interrupting overload currents are serially connected to each other in the tube. The means for interrupting major fault currents includes a fusible element of sheet metal having at least one perforation or point of reduced cross-section. A pulverulent arc-quenching filler is provided inside the tube. The means for interrupting overload currents includes a conductive housing and a plunger, wherein the housing has first and second ends and defines an opening at the first end and a shoulder at the second end. The plunger is arranged inside the housing in a coaxial relation with a spring and projects from the first end, with the outermost end of the plunger connected by a solder joint to an end of the fusible element which is remote from a first one of said terminal caps. The solder joint restrains the plunger from movement through the opening as a result of the plunger being biased away from the first terminal cap by a spiral spring. Preferably, the spiral spring is formed as a coiled spring having a relatively large diameter first end portion and a relatively small diameter second end portion. The coils of the spring are configured so they may be placed in a coplanar configuration, with individual coils nesting interposed between adjacent coils. When unbiased the coils of said spring spread out with said second end portion of the spring extending relative to the first end portion towards the second one of said terminal caps. The spring is preferably reverse loaded in an extended position whereby the second end portion of the spring is pulled axially inwardly past the first end portion, toward the first end cap. The spring is held in the reverse loaded position with first end portion of the spring abutting the shoulder and said second end portion of the spring abutting a flange formed by the plunger.

Accordingly, in one aspect the present invention resides in an electrical interruption device to interrupt current flow therethrough on a predetermined condition occurring, the device comprising, spiral spring means having coils winding continuously about and constantly approaching a central axis, with successive coils having sufficiently reduced radius to pass axially through the center of an immediately outward adjacent coil, the spring means having a first end portion and a second end portion, the spring means having an inherent tendency to assume an unbiased first position, the spring means being axially deformable from the unbiased first position to a second loaded position by drawing said second end portion along the axis relative to said first end portion, holding means for engaging the first and second end portions to retain the spring means in the second loaded position, said holding means comprising coupling means releasably securing the second end portion, wherein on said predetermined condition occurring said coupling means releases said second end portion to permit said spring means to move towards said unbiased first position, said spring means in moving towards said unbiased first position actuating interruption of the current flow.

In another aspect, the present invention resides in an electric fuse comprising a tube of non-conducting material closed at both ends by a pair of terminals; separate means for interrupting major fault currents and means for interrupting overload currents serially connected to each other in said tube; said means for interrupting major fault currents including a fusible element, and said means for interrupting overload currents including, a housing having a first and a second end, and defining a cavity having an opening at the first end, a plunger having an interior end and an exterior end, and spring means, the plunger and spring means axially aligned within said cavity, said spring means comprising a substantially conical spiral spring having coils winding continuously about and constantly approaching a central axis, with successive coils having sufficiently reduced radius to pass axially through the center of an immediately outward adjacent coil, the conical spring having a relatively large diameter first end portion and an axially spaced relatively small diameter second end portion, the conical spring having an inherent tendency to assume an unbiased first position, said conical spring being axially deformable from the unbiased first position to a second reverse loaded position by drawing the second end portion along the axis past the first end portion, said interior end of said plunger secured to the second end of the spring means within the cavity with the exterior end of the plunger projecting out from said first end opening and releasably secured by coupling means with an end of said fusible element in electrical connection therewith, the coupling means comprising a first low temperature solder mass having a predetermined melting temperature, the first solder mass restraining the plunger from movement at temperatures of the solder mass below said predetermined temperature, said conical spring loaded in said second position with said first end portion secured to said housing spaced from the first end opening and said exterior end of the plunger secured to the end of the fusible element, wherein on the coupling means releasing the plunger the spring draws the plunger further into the cavity away from said end of said fusible element a distance sufficient to substantially interrupt the flow of current between said first and second terminal caps.

BRIEF DESCRIPTION OF THE DRAWINGS

Further objects and advantages of the invention will appear from the following description taken together with the accompanying drawings in which.

DETAILED DESCRIPTION

Figure 1:
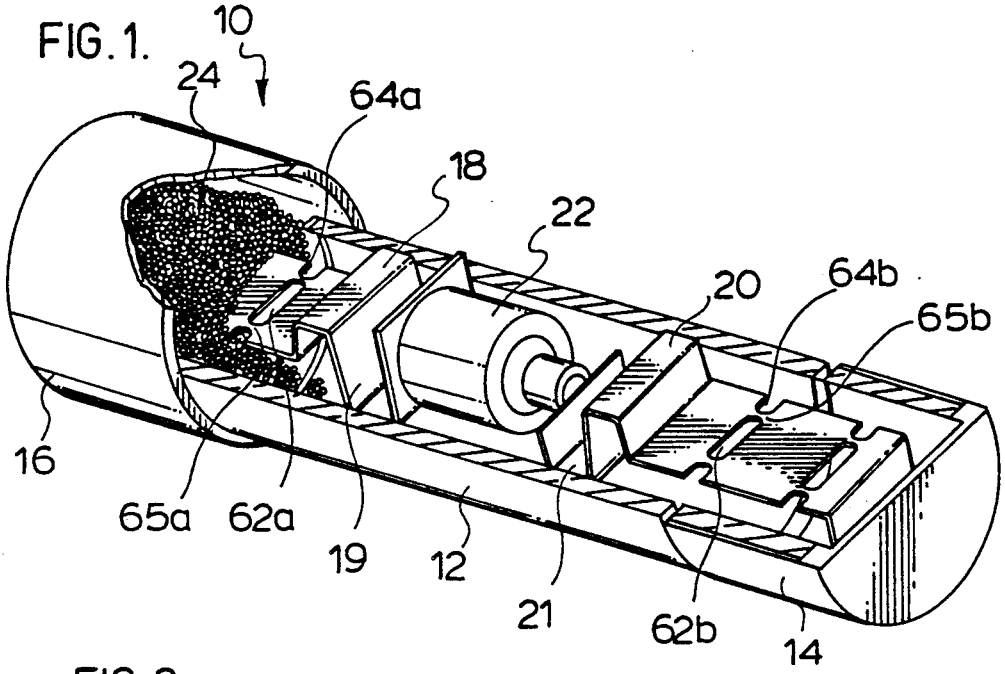
FIG. 1 is a cut-away pictorial view of a dual element fuse according to the present invention.

Reference is now made to FIG. I, which shows a fuse 10 which includes an electrically insulative tube 12 closed at each end thereof by conductive metal terminal caps 14,16. Housed within the insulative tube 12 are fusible elements 18,20 and an overload protection device or preassembly 22. The fusible elements 18,20 and overload preassembly 22 connected in series, providing a conductive path for electric communication between terminal cap 14 and terminal cap 16.

Pulverulent arc-quenching material 24, such as silica sand with or without a binder or fine calcium sulfate powders, is provided within the tube 12 about the fusible elements 18,20 and overload preassembly 22.

Figure 2:
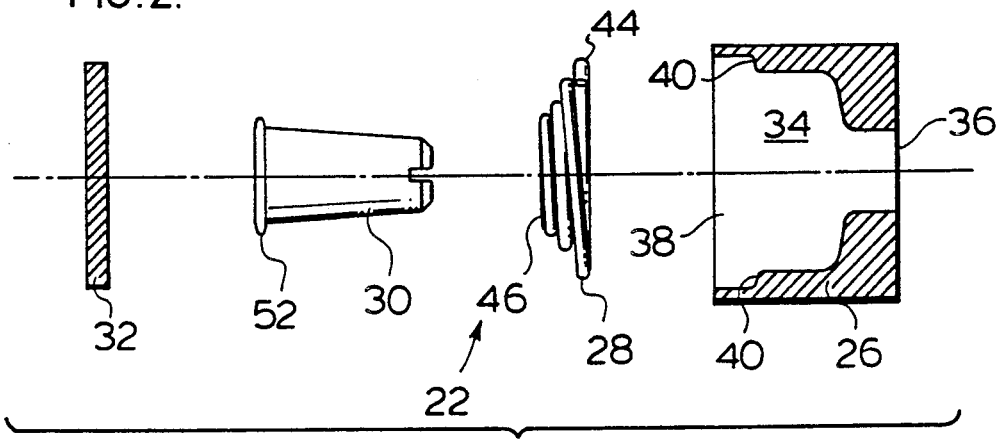
FIG. 2 is an exploded view of a preferred thermally sensitive overload preassembly according to the present invention.

FIG. 2 shows the overload preassembly 22 comprising conductive copper barrel-shaped housing 26, stainless steel spiral coil spring 28, conductive copper plunger 30 and conductive copper back plate 32.

The casing 26 defines a hollow cavity 34 having first and second end openings 36,38. A circumferential shoulder 40 is formed about an inside surface of casing 26, adjacent the second end opening 38.

Figure 5:
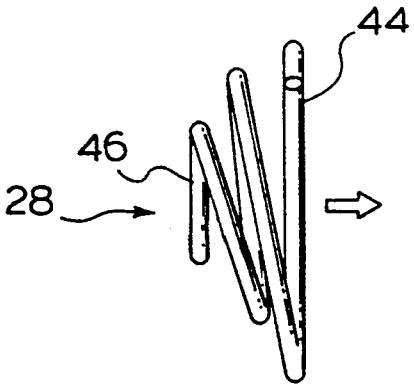
FIG. 5 is a perspective side view of a preferred spring for use with the thermally sensitive overload protection device of FIG. 2.

The coil spring 28 and plunger 30 are axially aligned within cavity 34. FIG. 5 shows the spring 28 in an unbiased position as preferably generally conical in shape, having a relatively large diameter first end portion 44, which spirals inwardly in an arc of continuously decreasing radius to a relatively small diameter second end portion 46.

Figure 6:
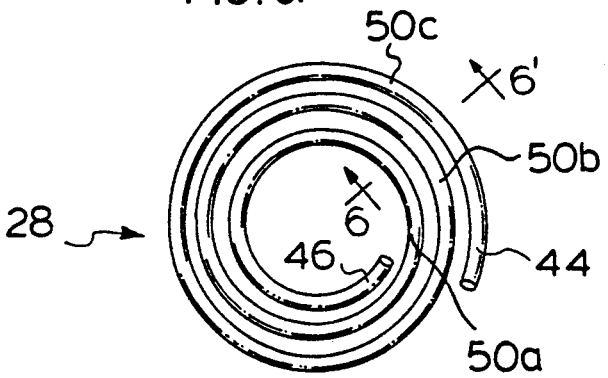
FIG. 6 is a plan view of the spring of FIG. 5 with the coils lying in a coplanar orientation.
Figure 7:
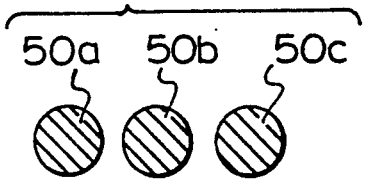
FIG. 7 is a cross-sectional view of the spring of FIG. 6 taken along line 6—6'.

The outer-most diameter of the first end portion 44 is selected small enough to allow insertion of the spring 28 into the cavity 34 through second end opening 38, but large enough to result in the abutting engagement of the end portion 44 against shoulder 40. FIGS. 6 and 7 show the spring 28 in a flattened state, wherein each of the individual coils 50*a*, 50*b*, 50*c* are configured to lie coplanar. As is apparent, the radius of the coils decreases toward the second end portion 46 in an amount sufficient to allow the nesting of the individual coils 50*b* between adjacent coils 50*a*, 50*c*, such that successive inwardly displaced coils 50*a*, 50*b* have a sufficiently reduced radius to pass axially through the center of an immediately outward adjacent coil 50*b*, 50*c*, respectively.

The assembly of preassembly 22 may best be described with reference to FIG. 2, which shows the spring in the unbiased position, and FIG. 3 which shows the assembled preassembly 22, with the spring 28 in a tensioned reverse loaded configuration. As seen best in FIG. 2, the unbiased spring 28 is positioned in the cavity 34, with the first end portion 44 abutting shoulder 40, and the second end portion 46 of the spring 28 extending away from the first end opening 36.

The plunger 30 is axially aligned with the spring 28 and inserted into the cavity 34 through the second end opening 38.

On insertion, the plunger 30 is passed through the second end portion 46 of spring 28, with a retaining flange 52 formed on the plunger 30 engaging the coils of second end portion 46. The plunger 30 is pushed from its flange 52 end through the spring 28 to deform the spring 28 to the reverse loaded configuration, wherein the smaller diameter coils of the second end portion 46 are moved inwardly through and past the larger diameter coils of the first end portion 44, so as to extend towards the first end opening 36, as seen in FIG. 3. The spring 28 in the reverse loaded position is under tension and tends to return to its unbiased position.

The length of the plunger 30 is selected such that when received within the cavity 34, the first end of the plunger 30 passes through the spring 28 and extends outwardly through first end opening 36, beyond the housing 26. The plunger 30 preferably tapers marginally outward from its outwardly extending end towards the inner end and flange 52. The sizing of the plunger 30 is selected to permit substantially unhindered movement of the plunger 30 inwardly into the chamber 34, through the opening 36.

Low temperature solder masses 54,56, preferably eutectic solder having a fixed melting point of generally less than 200° C., are applied to the preassembly 22. Solder masses 54,56 act to secure the plunger 30 and casing 26 and the plunger 30 and fusible element 20, respectively, to restrain the plunger 30 from movement further into the chamber 34 and prevent the return of spring 28 toward its unbiased position. If desired, solder mass 54 may be first applied about the plunger 30 to substantially seal the first end opening 36. The provision of solder mass 54 sealing the first end opening 36 is advantageous in that it minimizes the likelihood of the pulverulent material 24 interfering with the sliding of the plunger 30 on activation of the preassembly 22.

As is to be appreciated, the melting temperature of each solder mass 54,56 are selected as predetermined temperatures and preferably are substantially the same.

Back plate 32 is secured over the second end opening 38, preferably initially by crimping, to substantially seal opening 38 and prevent the arc-quenching pulverulent material 24 from entering the cavity 34 therethrough and interfering with the operation of preassembly 22. Later a high temperature solder 58 is provided to further secure the back plate 32 in place. By high temperature solder, it is generally meant that solder mass 58 has a higher melting temperature relative to solder masses 54,56, preferably higher than 200° C.

In assembly, the solder 54 preferably achieves both mechanical and electrical purposes. Mechanically, below its melting temperature solder mass 54 retains spring 28 in the reverse loaded position by restricting movement of plunger 30. Once the melting temperature is reached solder 54 melts in conjunction with solder 56, to permit the return of the spring 28 to an untensioned state. Electrically, the solder mass 54 provides a good electrical connection and current path between the housing 26 and plunger 30.

Figure 3:
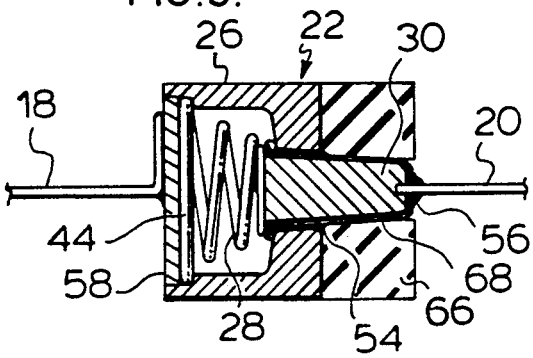
FIG. 3 is a cross-sectional view of a preferred thermally sensitive overload protection device of FIG. 2 when closed.
Figure 4:
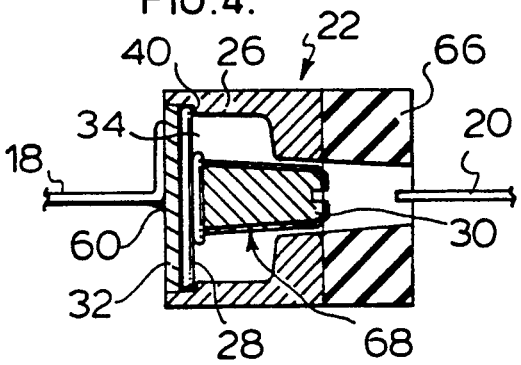
FIG. 4 is a cross-sectional view of a preferred thermally sensitive overload protection device of FIG. 2 when open.

As seen best in FIGS. 3 and 4, the preferred preassembly 22 includes an electrically insulative sleeve, preferably comprised of silicone 66 (organosilicon oxide polymers having the general formula —$R_2Si$ —O—; wherein R is a monovalent organic radical) about the portion of the plunger 30, which extends outwardly from the housing 26.

Providing the silicone sleeve 66 is advantageous in that it assists in preventing the pulverulent arc-quenching material 24 from interfering with the smooth sliding of the plunger 30 during the activation of the preassembly 22. The silicone sleeve 66 substantially isolates the movable plunger 30 of the preassembly 22 from the surrounding arc-quenching material 24, eliminating the need to isolate the preassembly 22 in a separate chamber within the fuse 10. The silicone sleeve 66 increases the interruptive capacity of the preassembly 22 to overload currents of a higher amperage. Once the preassembly 22 is activated, the movement of the plunger 30 inwardly into the sleeve 66, as seen in FIG. 4, creates a pressure effect which assists in extinguishing any current arc. The silicone sleeve 66 is further advantageous in that it assists in containing and controlling any arcing of electrical current occurring between the end of the plunger 30 and the adjacent end of fusible element 22, once the preassembly 22 is activated.

Preferably the plunger 30 is provided with a thin electrically conductive lubricating coating, such as tin plating 68. The tin plating 68 plasticizes upon heating of the plunger 30 during overload conditions to minimize the extent the silicone sleeve 66 adheres to the plunger 30 and interferes with its sliding movement. The plasticizing of the tin plating also assists in lubricating the plunger 30, easing its sliding movement through opening 36. It is to be appreciated that in addition to tin plating 68, the lubricating coating may also comprise other conductive metals, as for example tin alloys or bismuth alloys.

The silicone sleeve 66 may be preformed and applied in assembly or molded directly about the preassembly and its plunger 30.

The overload preassembly 22 is connected within fuse 10 in series between fusible elements 18 and 20. Low temperature solder mass 56 connects the fusible element 20 to the end of plunger 30. Fusible element 18 is secured in electrical connection with back plate 32 by mean of high temperature solder junction 60. Preferably, back plate 32 may be tin plated as is known to assist in soldering such that in assembly the application of high temperature solder 58 and 60 is optimally accomplished in a single operation.

As seen in FIG. 1, each of fusible elements 18 and 20 comprise a flat ribbon of conductive copper. Each fusible element 18,20 comprises in effect three portions, a first castellated insulating fold portion adjacent the preassembly 22, a second flat central fusible portion and a third terminal portion adjacent each terminal cap. The central fusible portion is shown as planar and having at spaced locations therethrough, respective apertures 62*a*,62*b* and points of reduced cross-sectional area 64*a*,64*b* which define one or more narrow constrictions 65*a*,65*b*. The third terminal portion of each fusible element 18,20 is bent, and while not shown, may be reduced in width to be secured to a respective terminal cap 16,14 in known manner.

The first insulating fold portion of each fusible element 18,20 is secured directly to the preassembly 22 and is formed by insulating folds 19,21. Each of the insulating folds 19,21 comprise a portion of respective fusible elements 18,20 which contain no constrictions. As shown in FIG. 1, the insulating fold portions comprise a portion of a conductive element which has been folded into a full castellated cycle for compaction. Insulating folds 19,21 partially absorb and dissipate heat generated by short term overload current flow through adjacent constrictions 65, to minimize the likelihood of premature activation of the preassembly 22. On a sustained low overload current, insulating fold portions transfer heat and warm the preassembly 22 assisting in its operation.

In operation, short circuit conditions producing high over currents cause the fusible elements 18,20 to immediately heat to the melting point in the area of the constrictions 65*a*, 65*b*. The high over current passing through the fusible elements 18,20, causes rapid heating and melting at the constrictions 65*a*, 65*b*, resulting in the immediate circuit interruption by the fuse 10. The arc-quenching pulverulent material 24 minimizes current arcing and assists in maintaining a break in the path of electric current flow between terminal caps 14 and 16.

The operation of the preassembly 22 may best be described with reference to FIGS. 3 and 4 which show the preassembly 22 secured in between the two fusible elements 18,20, which are fixed in position relative thereto.

The resistance and thermal mass of the preassembly 22, combined with the melting temperature of the solder masses 54,56, is selected such that the preassembly 22 will activate only after a sustained moderate overload current condition. Current flowing through the overload preassembly 22 and elements 18,20, on a sustained overload current combines with the thermal mass of the housing 26 and plunger 30 to gradually raise the temperature therein. The increase in temperature in the preassembly 22 results in the tin plating 68 on the plunger 30 plasticizing, thereby reducing the adherence of the silicone sleeve 66 to the plunger 30. When the overload current occurs for a time which is sufficient to raise the preassembly 22 temperature to that where the solder masses 54,56 melt, the plunger 30 is released.

As seen in FIG. 4, once released, the plunger 30 is drawn by the spring 28 away from fusible element 20 further inwardly into the cavity 34 and the silicone sleeve 66. The plunger 30 is moved away from the fixed fusible element 20 a distance sufficient to break the flow of electric current therebetween. The extended end of the plunger 30 becomes retracted within the silicone sleeve 66, as is advantageous to assist in extinguishing and controlling arcing.

By providing a reverse loaded conical spring 28, the release of the plunger 30 causes the coils of the spring 28 to collapse inwardly into a substantially flat orientation against the back plate 32, with the plunger 30 moved therewith, so that the inward end of plunger 30 is biased against the back plate 32. As is to be appreciated, providing a spring 28 which tends to orient itself substantially flat against the back plate 32 is advantageous over conventional springs in that it enables the movement of the plunger 30 a sufficient distance from conductive element 20 to break the circuit, while minimizing the required axial length of the housing 26.

Figure 8:
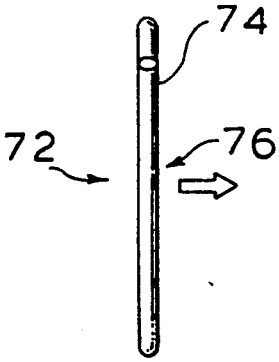
FIG. 8 is a perspective side view of a further spring for use with the thermally sensitive overload protection device of FIG. 2.

While the provision of reverse loaded conical spring 28 is advantageous in that it places substantially the same force on the plunger 30 as a conventional compressed or extended helical spring having almost twice the length, it is not essential. FIG. 8 shows a second spiral coil spring 72 for use with the present invention and which comprises a large diameter first end portion 74 which spirals inwardly into a relatively smaller diameter second end portion 76. The coils of spring 72 gradually decrease in radius from the first end portion 74 to the second end portion 76. When unbiased, the individual coils of the spring 72 nest, lying flat and coplanar, in substantially the same configuration as the flattened spring 28 shown in FIGS. 6 and 7.

Spring 72 is inserted into the preassembly casing 32 in substantially the same manner as spring 28 with the first end portion 74 abutting shoulder 40 and the second end portion 76 secured in abutting relationship with the flange 52 of the plunger 30. The insertion of the plunger 30 into the cavity 34, projecting through opening 36 extends the second end portion 76 under tension towards the first end opening 36.

On activation of the preassembly 22, the spring 72, with plunger 30, tends to return to an unbiased position, fully collapsed with the coils of first and second end portions 74,76 lying in the same plane with each other and with the annular shoulder 40.

Figure 9:
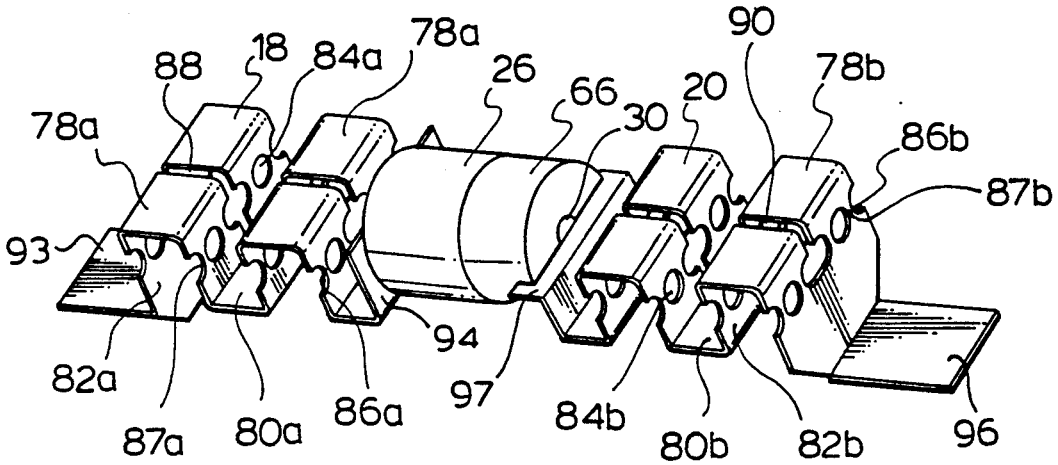
FIGS. 9 and 10 are partial perspective views of preferred thermally sensitive overload protection devices in series communication with electric conductive elements for short circuit protection, for use in the fuse of FIG. 1.
Figure 10:
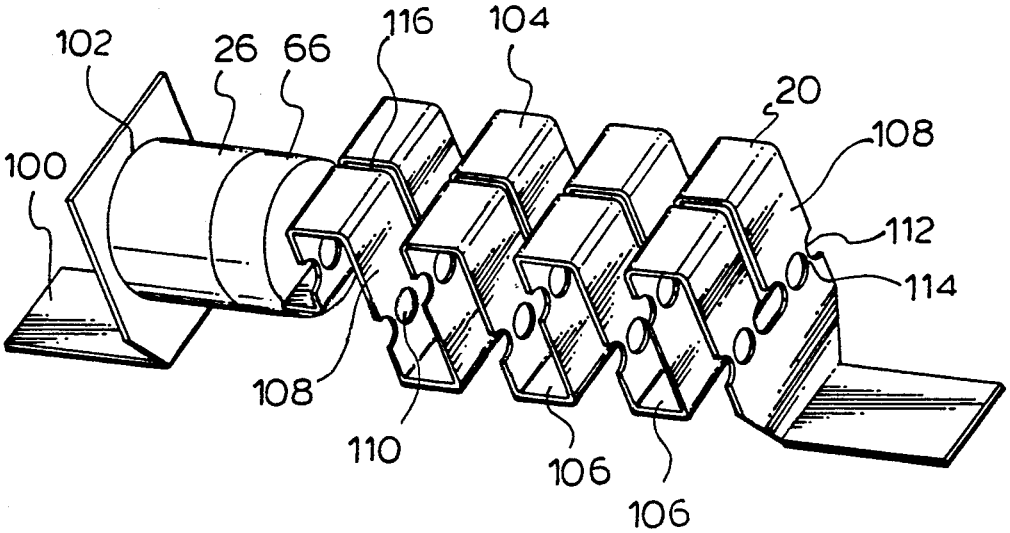

Reference may now be had to FIGS. 9 and 10 which show two preferred fusible element/overload preassembly configurations, wherein equivalent reference numerals are used to designate equivalent components. In each of the embodiments shown in FIGS. 9 and 10, the overload preassembly 22 is provided with an insulating silicone sleeve 66, and is identical to that shown in FIG. 3.

In FIG. 9, each of the fusible elements 18 and 20 comprise a flat strip of copper which has been folded in a castellated manner for compaction. Fusible elements 18,20 have respective flat top portions 78*a*, 78*b*, flat valley portions 80*a*, 80*b*, and flat side portions 82*a*, 82*b*. Each flat side portion 82 extends perpendicular to and connects adjacent top and valley portions 78,80.

A number of equally spaced apertures 84*a*, 84*b* and points of reduced cross-section 86*a*, 86*b* define constrictions 87*a*, 87*b* in each respective fusible element 18,20. Each fusible element 18,20 is further pierced by a respective longitudinally extending medial slot 88,90.

As with constrictions 65*a*, 65*b*, constrictions 87*a*, 87*b* have very small diameter cross-sections in which the current densities can be quite high. As long as current flowing through fusible elements 18,20 is less than the rating for each element 18,20, the constrictions 87*a*, 87*b* will remain intact. Slit 88 divides fusible element 18 into two preferably equal conductive parallel paths in electrically parallel relation, each having one or more constrictions. Slit 90 similarly divides element 20 into electrically parallel conductive paths. The provision of two parallel paths in each element 18,20 allows for dynamic current transfer from one parallel path to the other during extremely high overload operation. The provision of a slit is optionally provided to lower the level of over-current required to melt a constriction 65 sufficiently such that there is overlap between the upper level of overload current, which is interrupted by the preassembly 22 and the lower level of over-current required to activate fusible elements 18,20.

Terminal folds 93,96 are provided in fusible element 18 20, adjacent respective terminal caps 16,14. Terminal folds 93,96 preferably have reduced width and are devoid of apertures, points of reduced cross-section or slits.

Insulating folds 94,97 are provided in fusible elements 18,20 adjacent preassembly 22. The insulating folds 94,97 comprise a portion of a castellated fold cycle and are devoid of apertures, fusible constrictions or slits. The insulating folds 94,97 act to partially absorb and dissipate heat generated by the electric current flow through constrictions 87, reducing the likelihood of premature activation of the preassembly 22.

In the embodiment shown in FIG. 10, a conductive copper element 100 has been substituted for fusible element 18 and is secured to the overload preassembly by high temperature solder 102. Fusible element 20 is folded in a castellated manner having a similar configuration to that shown in FIG. 9 having flat top portions 104, flat valley portions 106 and flat side portions 108. Parallel spaced pairs of apertures 110 and adjacent pairs of points of reduced cross-sectional area 112 define restriction 114 in each of side portions 108. Each one of the pairs of apertures I10 is separated by an elongate medial slit 116 extending longitudinally through fusible element 20.

The constrictions 114 act in substantially the same manner as constriction 87 shown in FIG. 9, and are identical but for the constrictions 114 of each side portion 108 being laterally offset with respect to adjacent constrictions 114 in adjacent side portions 108. With constrictions 87 aligned, as seen in FIG. 9, it is possible that an electric current may arc in a straight line along the axis of the fuse. Providing constrictions 114 which are out of alignment with respect to adjacent constrictions 114 is advantageous in that it reduces the likelihood of straight line arcing and maximizes the segregation of separate current arc locations between side portions 108, after the constrictions 114 have melted. Maximizing the distance between adjacent constrictions 114 is advantageous in that it reduces the likelihood of current arcing between adjacent side portions 108.

While the embodiment discloses the use of the spiral coil spring in a preassembly, it is to be appreciated that the invention is not so limited. Other configurations of fuses incorporating the disclosed spiral spring as a means of interrupting electric current flow will now become apparent.

Although the preferred embodiment has been shown as comprising an overload preassembly connected in series with fusible elements within a tube, it is to be appreciated that the preassembly is not so limited and may equally be used in any device where sustained overload current protection is desired.

Similarly, the preferred overload preassembly and fusible elements are disclosed as comprising copper, however, other metals and conductive materials such as alloys of copper and silver may equally be used.

The use of castellated fusible elements formed from a ribbon of metal is advantageous in that it permits the premanufacture of a compact preassembly/fusible element preformed unit, which may then be used in achieving a simplified fuse manufacture. It is to be appreciated, however, that the invention is not so limited, and other fusible elements, such as flat metal ribbons having restrictions, metal ribbons having insulating folds or fusible wires, may also be used.

The preferred embodiment of the invention discloses a fuse for use with moderately high or high electric currents. Persons skilled in this art will appreciate that where the preassembly is to be used in conjunction with low amperage fuses, the thermally sensitive preassembly may be provided with a heating device. A preferred heating device comprises an electrically insulated heater wire wound about the preassembly housing and electrically connected in series with the current flowing through the fuse.

The present invention illustrates in FIG. 2 a preassembly which may advantageously be manufactured as a preformed component either with or without the silicone sleeve shown in FIG. 3. With plunger 30 retained in by solder 54, the preassembly without fusible elements 18 and 20 may be premanufactured to a modular component for storage and later used in fuses as desired. A more complex modular component may also be premanufactured comprising, for example, the preassembly of FIG. 2 with elements 18 and 20 secured thereto. The modular component comprising the preassembly and elements 18 and 20, may be stored ready for use in insertion as a whole unit in final assembly of a fuse. The fact that the preassembly is a sealed unit greatly facilitates fuse manufacture when arc-quenching material 14 is to be provided in the fuse.

With the preassembly forming a modular unit which may be readily mass manufactured, the preassembly can comprise a basic component for a progressive series of fuses of different ratings by incorporating different components, such as different elements 18 and 20 with each preassembly. Moreover, more than one modular component comprising a preassembly and elements 18 and 20 may be provided in parallel in a single fuse.

The preferred embodiments of the fuses illustrated in FIGS. 1, 9 and 10 each use the preassembly of FIG. 2 in which in a closed fuse, the current flow is not along the spring 28. Rather, current flow as for example with the fuse 10 of FIG. 1 is sequentially via element 18, solder mass 60, back plate 32, solder mass 58, casing 26, solder mass 54, plunger 30, solder mass 56 and element 20. The spring 28 operates to interrupt the current by acting on plunger 30. Similar such springs may in other embodiments act differently to activate current interruption. For example, in a simpler fuse the current could pass along a reverse loaded conical spring tensioned between two terminals and joined to one terminal by a solder mass. On the solder mass heating, the spring, by its collapse would interrupt the current. Other configurations for advantageous use of such a conical spring will occur to persons skilled in the art.

Although the disclosure describes and illustrates preferred embodiments of the invention, it is not limited to these particular embodiments. Many variations and modifications will now occur to those skilled in the art. For a definition of the invention reference is made to the appended claims.

The embodiments of the invention in which an exclusive property or privilege is claimed are defined as follows:

1. An electrical interruption device to interrupt current flow therethrough on a predetermined condition occurring, the device comprising, spiral spring means having coils winding continuously about and constantly approaching a central axis, with successive coils having sufficiently reduced radius to pass axially through the center of an immediately outward adjacent coil, the spring means having a first end portion and a second end portion, the spring means having an inherent tendency to assume an unbiased first position, the spring means being axially deformable from the unbiased first position to a second loaded position by drawing said second end portion along the axis relative to said first end portion, holding means for engaging the first and second end portions to retain the spring means in the second loaded position, said holding means comprising coupling means releasably securing the second end portion, wherein on said predetermined condition occurring said coupling means releases said second end portion to permit said spring means to move towards said unbiased first position, said spring means in moving towards said unbiased first position actuating interruption of the current flow.

2. An electrical interruption device as claimed in claim 1, wherein in said unbiased first position said first end portion being spaced axially from said second end portion, and in said second position said spring means being reverse loaded by said second end portion having been drawn along said axis past said first end portion.

3. An electrical interruption device as claimed in claim 2, wherein the radius of the coils at said first end portion is larger than the radius of coils at said second end portion.

4. An electrical interruption device as claimed in claim 3, wherein said spring means comprises a substantially conical spiral coil spring.

5. An electrical interruption device as claimed in claim 1, wherein in said unbiased first portion said first end portion is axially aligned with said second end portion with the coils nesting interposed between adjacent coils substantially in the same plane.

6. An electrical interruption device as claimed in claim 1, further comprising a housing and a plunger, said housing having a first end and a second end and defining a cavity having a first end opening at the first end, said plunger disposed within said cavity with an end projecting outwardly therefrom through said first opening, said spring means disposed in said cavity in coaxial relation with said plunger, with said second end portion of said spring secured to said plunger, said first end portion of said spring secured to the housing spaced from said first end, the spring means biasing said plunger towards the second end of said housing.

7. An electrical interruption device as claimed in claim 6, wherein said coupling means comprises a first low temperature solder mass having a predetermined melting temperature, said first solder mass restraining the plunger from movement through said first end opening at temperatures of the solder mass below said predetermined melting temperature.

8. An electrical interruption device as claimed in claim 7, including a sleeve of electrically insulating material, said sleeve disposed about a portion of said plunger extending through said opening, such that on movement of the spring means towards the first position the end of the plunger is retracted into the sleeve.

9. An electrical interruption device as claimed in claim 8, wherein said sleeve of insulating material comprises silicone.

10. An electrical interruption device as claimed in claim 9, including lubrication means disposed about said plunger where it passes through the first end opening and the sleeve.

11. An electrical interruption device as claimed in claim 10, wherein said lubrication means comprises a coating of tin about a portion of said plunger.

12. An electrical interruption device as claimed in claim 8, wherein said housing having a second end opening at said second end thereof, sized to allow ingress of said spring means into said cavity, and a back plate secured to said housing to substantially seal said second end opening.

13. An electrical interruption device as claimed in claim 12, wherein said coupling means comprises a second low temperature solder mass disposed about said plunger where it passes through the first end opening to substantially seal said first end opening, the second solder mass having a predetermined melting temperature.

14. An electrical interruption device as claimed in claim 13, wherein said housing, said plunger and said back plate are electrically conductive.

15. An electrical interruption device as claimed in claim 11, wherein said first end portion of said spring means is secured to the housing by an annular shoulder formed in said housing about said second end opening.

16. An electrical interruption device as claimed in claim 15, wherein said plunger includes a flange, said second end portion of said spring means secured to said plunger in abutting engagement with said flange.

17. An electric fuse comprising a tube of non-conducting material closed at both ends by a pair of terminals; separate means for interrupting major fault currents and means for interrupting overload currents serially connected to each other in said tube; said means for interrupting major fault currents including a fusible element, and said means for interrupting overload currents including, a housing having a first and a second end, and defining a cavity having an opening at the first end, a plunger having an interior end and an exterior end, and spring means, the plunger and spring means axially aligned within said cavity, said spring means comprising a substantially conical spiral spring having coils winding continuously about and constantly approaching a central axis, with successive coils having sufficiently reduced radius to pass axially through the center of an immediately outward adjacent coil, the conical spring having a relatively large diameter first end portion and an axially spaced relatively small diameter second end portion, the conical spring having an inherent tendency to assume an unbiased first position, said conical spring being axially deformable from the unbiased first position to a second reverse loaded position by drawing the second end portion along the axis past the first end portion, said interior end of said plunger secured to the second end of the spring means within the cavity with the exterior end of the plunger projecting out from said first end opening and releasably secured by coupling means with an end of said fusible element in electrical connection therewith, the coupling means comprising a first low temperature solder mass having a predetermined melting temperature, the first solder mass restraining the plunger from movement at temperatures of the solder mass below said predetermined temperature, said conical spring loaded in said second position with said first end portion secured to said housing spaced from the first end opening and said exterior end of the plunger secured to the end of the fusible element, wherein on the coupling means releasing the plunger the spring draws the plunger further into the cavity away from said end of said fusible element a distance sufficient to substantially interrupt the flow of current between said first and second terminal caps.

18. An electric fuse as claimed in claim 17, wherein said housing further defines an opening at the second end said second end opening sized to allow ingress of said spring into said cavity, and includes a back plate secured over and sealing said second end opening, and wherein said coupling means further includes a second low temperature solder mass disposed about said plunger where it passes through the first end opening to substantially seal said first end opening, the second solder mass having a predetermined melting temperature.

19. An electric fuse as claimed in claim 18, wherein said housing having an annular shoulder formed adjacent said second end opening to retain the first end portion of the spring, and said plunger including a flange for securing in an abutting relationship said second end portion of said spring.

20. An electric fuse as claimed in claim 19, wherein said housing and said plunger comprise copper or copper alloy.

21. An electric fuse as claimed in claim 17, wherein said means for interrupting overload current further includes a sleeve of insulating material disposed about a portion of said plunger extending through said first end opening, such that on said spring drawing the plunger further into the cavity the exterior end of the plunger is retracted into the sleeve.

22. An electric fuse as claimed in claim 17, wherein said fusible element electrically connects said first one of said terminals and said overload protection means, said fusible element comprising an elongate planar ribbon having at least one point of reduced cross-section.

23. An electric fuse as claimed in claim 22, wherein said fusible element is folded in a substantially castellated manner having flat top portions, flat valley portions and flat side portions, said side portions extending generally perpendicular to and joining adjacent top and side portions.

24. An electric fuse as claimed in claim 22, wherein said fusible element further comprises an elongate medial slit.

25. An electric fuse as claimed in claim 22, wherein said means for interrupting overload currents further includes a sleeve of insulating material, said sleeve disposed about said plunger adjacent said end of said fusible element, such that on the spring drawing the plunger further within the cavity the plunger is retracted into the sleeve.

26. An electric fuse as claimed in claim 25, wherein said sleeve of insulating material comprises silicone.

* * * * *